United States Patent [19]

Yamaguchi

[11] 4,422,845

[45] Dec. 27, 1983

[54] LIQUID HYDROCARBON BURNER WITH VERTICALLY ADJUSTABLE WICK

[75] Inventor: Yozo Yamaguchi, Joetsu, Japan

[73] Assignee: Isaburo Yamaguchi, Nigata, Japan

[21] Appl. No.: 292,153

[22] Filed: Aug. 12, 1981

[30] Foreign Application Priority Data

Sep. 8, 1980 [JP] Japan ..... 55-123541
Apr. 15, 1981 [JP] Japan ..... 56-53242[U]

[51] Int. Cl.[3] ..... F23D 11/36; F23D 3/32

[52] U.S. Cl. ..... 431/153; 431/261; 431/301; 431/320; 431/255

[58] Field of Search ..... 431/153, 254, 255, 261, 431/298, 301, 304, 305, 306, 307, 308, 320, 344, 33, 88; 126/96

[56] References Cited

U.S. PATENT DOCUMENTS 3,279,524 10/1966 Nozaki et al. ..... 126/96
4,357,929 11/1982 Johnson ..... 126/96

FOREIGN PATENT DOCUMENTS 54-105333 8/1979 Japan ..... 431/307
1489973 10/1977 United Kingdom ..... 431/261

*Primary Examiner*—Samuel Scott
*Assistant Examiner*—Margaret A. Focarino
*Attorney, Agent, or Firm*—Young & Thompson

[57] ABSTRACT

A liquid hydrocarbon burner of the type having a vertically adjustable wick, comprises an inner ring on which the wick is mounted, an intermediate ring outside the inner ring and an outer ring outside the intermediate ring. The rings are relatively rotatably and relatively vertically movable; and guide pins disposed in slots in the rings ensure that when the outer ring is rotated, the inner ring will move vertically. Gas supply is provided, with an electrical circuit for igniting the gas which in turn ignites the wick. The gas supply and the ignition of the gas supply are controlled by rotation of the outer ring, in such a way that the gas is supplied and ignited once when the wick is raised, and again when the wick is lowered, this latter ignition serving to burn the fumes from the liquid hydrocarbon which would otherwise cause odors after the wick is extinguished.

7 Claims, 6 Drawing Figures

LIQUID HYDROCARBON BURNER WITH VERTICALLY ADJUSTABLE WICK

The present invention relates to a liquid hydrocarbon burner, more particularly of the type having a vertically adjustable wick which is ignited when raised and extinguished when lowered.

Various types of apparatus have been proposed for this purpose in the prior art. In the prior art, it is known manually to raise the wick to a position such that it can be ignited and will burn in its raised position. Upon extinguishment, the wick is pulled back into a wick guide cylinder and a forced draft of air extinguishes it. However, the prior art structure has suffered the disadvantage that an odor or unburned fumes of the liquid hydrocarbon persists. These fumes are emitted, because the parts have become heated to high temperature when the wick was burning.

It is an object of the present invention to provide a liquid hydrocarbon burner of the type with a vertically adjustable wick, in which a more readily combustible gas is used to ignite the wick.

Another object of the present invention is the provision of such a burner, in which means are provided for burning the fumes of the liquid hydrocarbon which are emitted after extinguishment of the wick.

These and other objects of the invention, along with the means for achieving them, will become apparent from a consideration of the following description, taken in connection with the accompanying drawings, in which.

Figure 1:
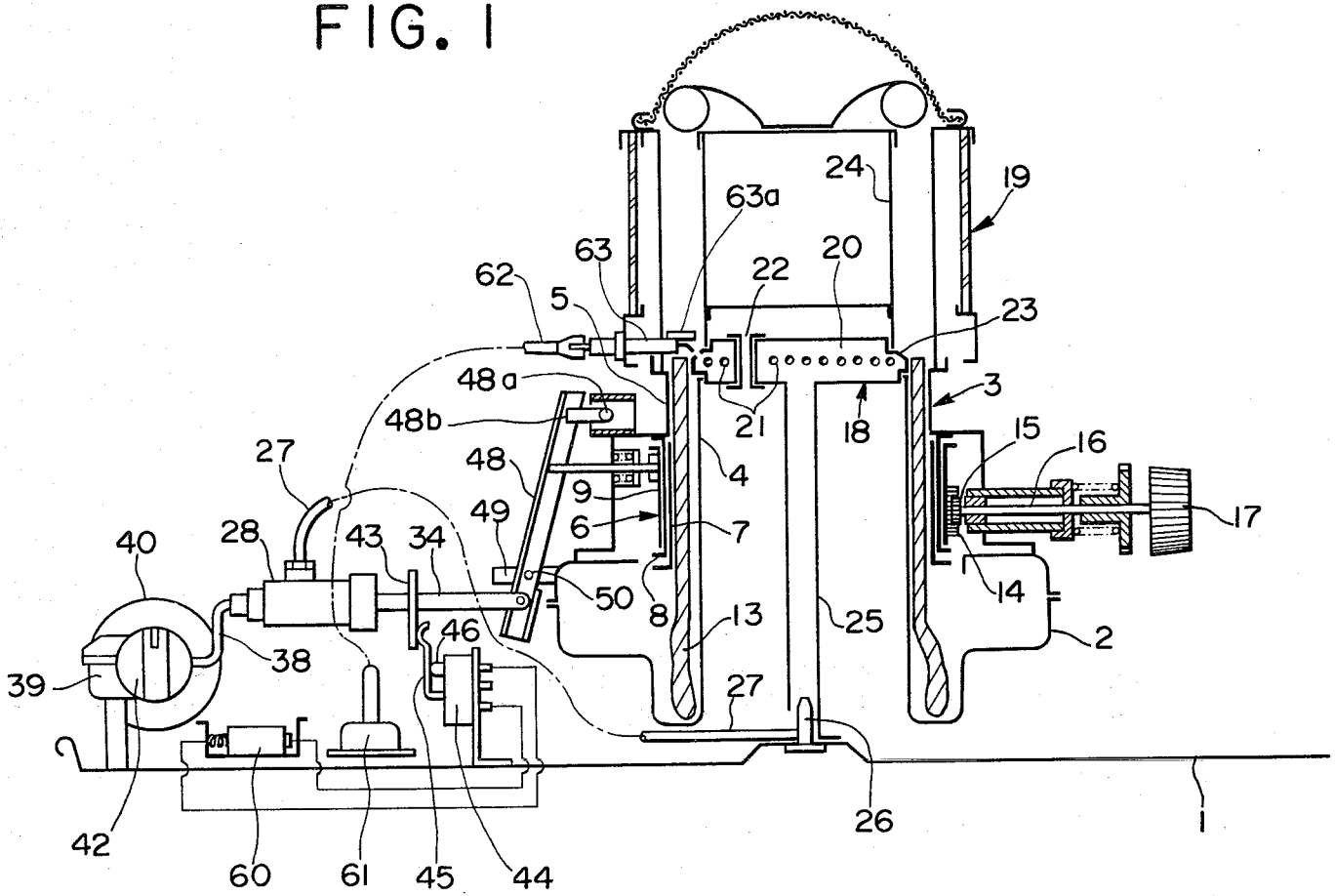
FIG. 1 is a somewhat schematic side elevational view, with parts in cross section, showing a liquid hydrocarbon burner according to the present invention.

Referring now to the drawings in greater detail, and first to FIG. 1 thereof, there is shown a burner according to the present invention, comprising a base plate 1 on which an oil reservoir 2 is mounted at a distance above base plate 1. A wick guide cylinder 3 is comprised of an inner wick sleeve 4 and an outer wick sleeve 5. Wick drive mechanism 6 is provided, comprising a vertically movable inner ring 7, a fixed intermediate ring 8, and a rotatable outer ring 9. Plural guide pins 10 extend outwardly from inner ring 7 and are received in vertical guide slots 11 in intermediate ring 8 and inclined guide slots 12 in outer ring 9. Thus, rings 7 and 9 are rotatable and vertically movable relative to each other, on opposite sides of intermediate ring 8 which is fixed to outer wick sleeve 5.

A combustion wick 13 is secured to inner ring 7; and a rack 14 is fixed to outer ring 9. Rack 14 meshes with a pinion 15 which is fixed to a pinion shaft 16. A knob 17 on pinion shaft 16 permits turning shaft 16 to rotate pinion 15 and to move rack 14 thereby causing outer ring 9 to rotate. Upon this rotation of outer ring 9, inner ring 7 is moved up or down by the guide grooves 11 and 12 and pins 10, thereby to move wick 13 up or down, depending on the direction of rotation of knob 17.

A burner head 18 is disposed at the upper end of inner wick sleeve 4. A chimney 19 rests on burner head 18 and on outer wick sleeve 5. Burner head 18 has a gas expanding chamber 20 (see FIGS. 1 and 4) and flame bores 21 are provided entirely about the periphery of the upper wall portion of chamber 20. A secondary air intake opening is formed on burner head 18 by means of a pipe 22 which extends through burner head 18. A bevelled portion 23 is formed on an outer peripheral edge of the upper surface of burner head 18; and on this inclined portion rests the lower end of an inner flame sleeve 24 of chimney 19.

A gas mixing pipe 25 extends down from burner head 18. A nozzle 26 is disposed at the lower end of pipe 25 and is connected to a gas valve 28 by means of a gas supply pipe 27.

Figure 2:
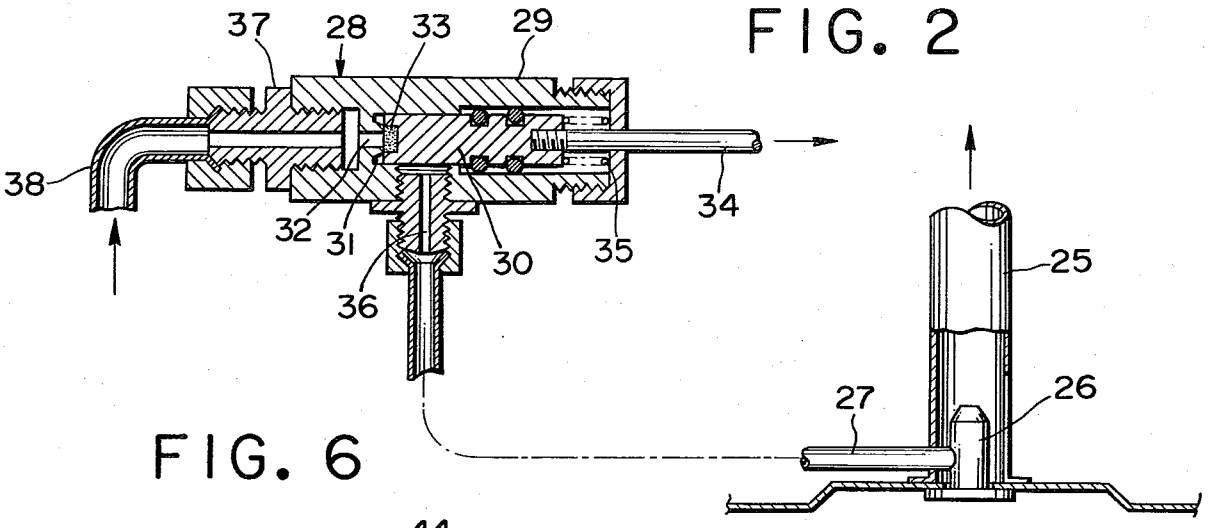
FIG. 2 is a fragmentary cross-sectional view of the gas control valve and nozzle of the burner.

Gas valve 28 is shown in detail in FIG. 2, and comprises a valve body 29 containing a slidable valve member 30. A valve seat 31 integral with valve body 29 surrounds a gas inlet passage 32 and is sealed in the closed position by resilient material 33 carried by valve member 30. An actuating rod 34 secured to valve member 30 extends outwardly beyond valve body 29 and is urged to the left by coil compression spring 35, whereby valve 28 is normally closed.

Valve body 29 has a gas outlet passage 36 which communicates with pipe 27. A gas supply pipe 38 is connected to passage 32 via connecting member 37. Pipe 38 communicates with a gas regulator 39 by which gas under pressure from a tank 40 is supplied via pipe 41 under the control of a knob 42.

Rod 34 carries an actuating plate 43 adapted to contact the operating plate 45 of a microswitch 44 via a switch member 46.

Figure 3:
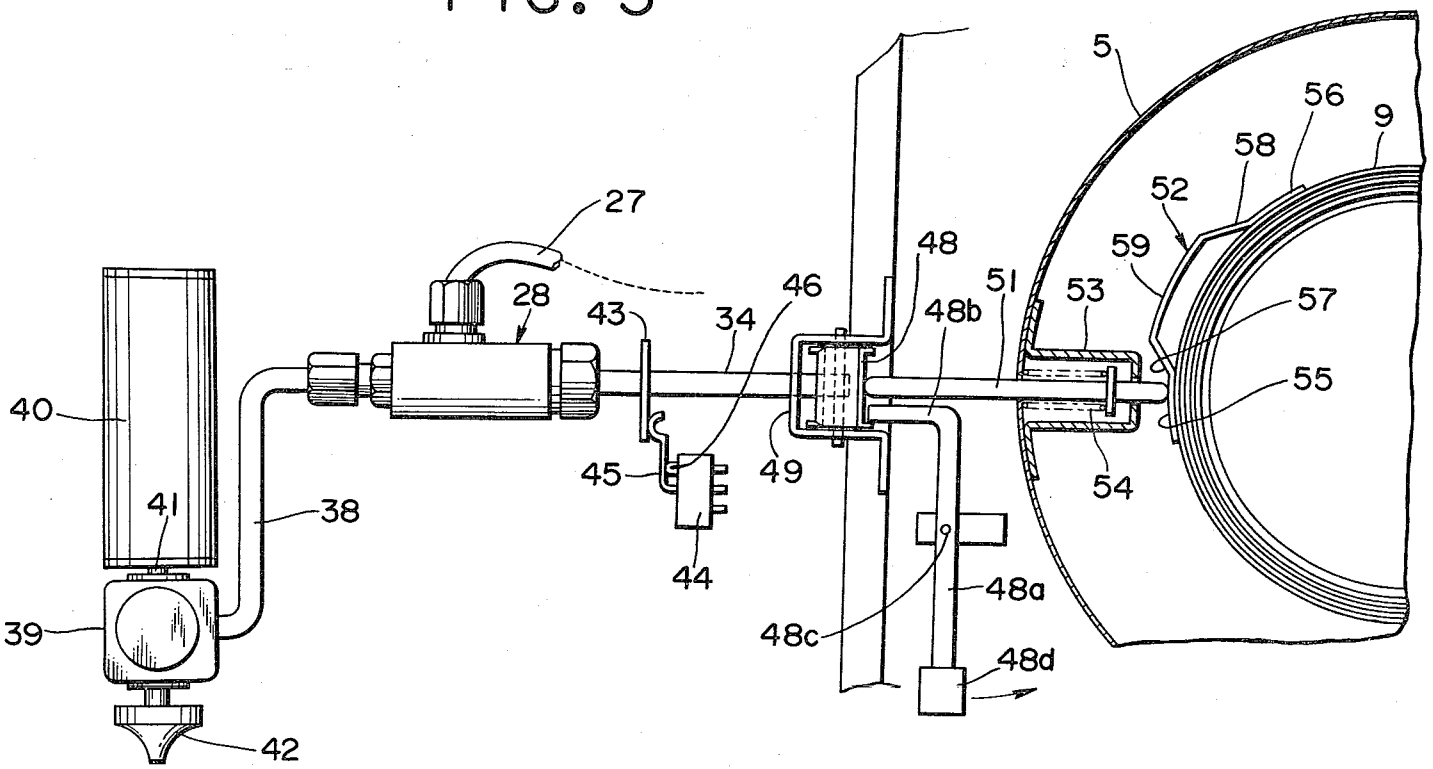
FIG. 3 is an enlarged top plan view, with parts in cross section, of the gas supply system.
Figures 4, 5:
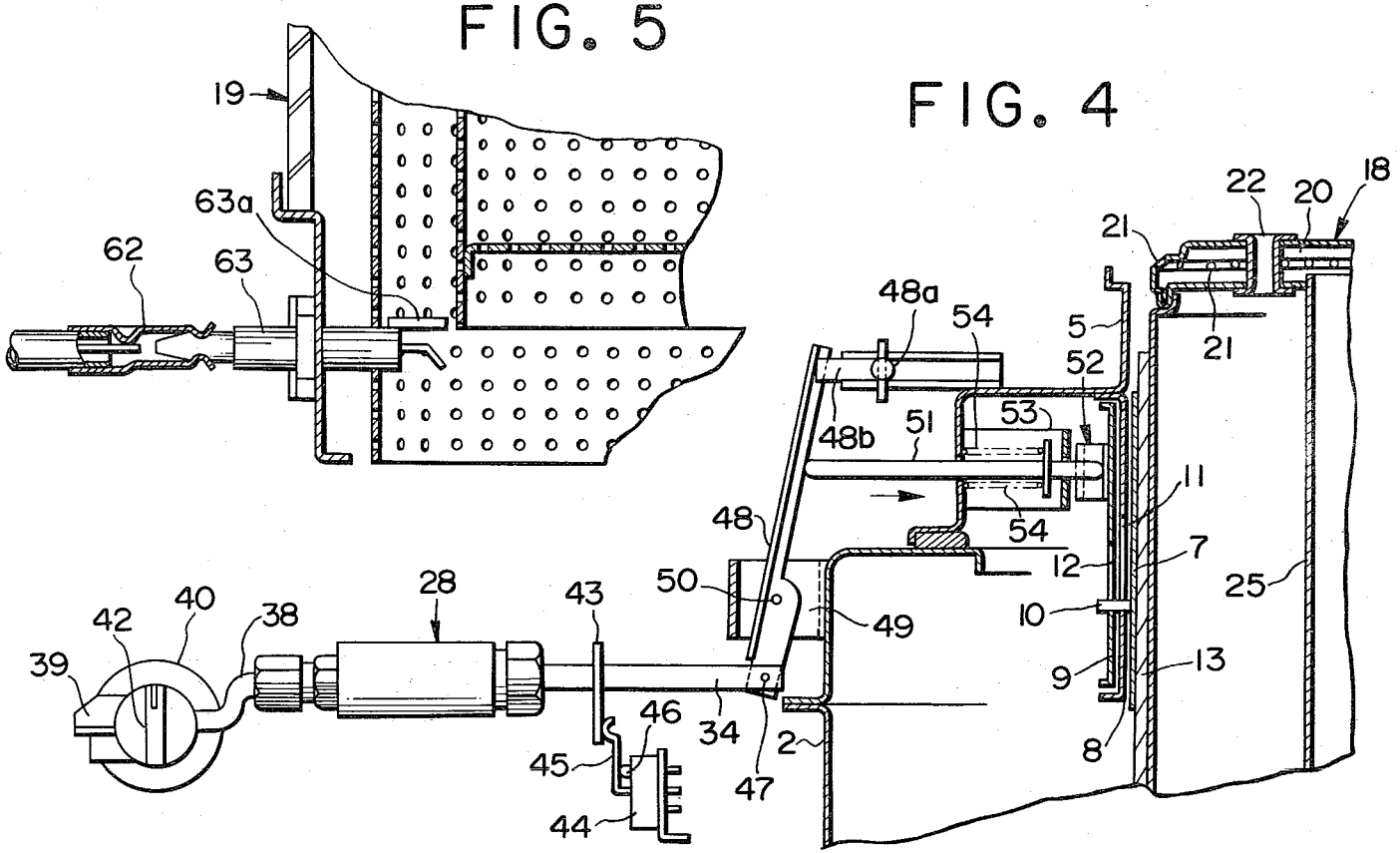
FIG. 4 is a side elevational view, with parts in cross section, of the structure shown in FIG. 3.
FIG. 5 is an enlarged fragmentary cross-sectional view of the gas ignition electrode assembly.

As best seen in FIG. 4, the free end of rod 34 is pivotally connected via pivot pin 47 with the lower end of a lever 48, which in turn is pivotally mounted on a bracket 49 on reservoir 2 by means of a pivot pin 50. The other end of lever 48 contacts one end of a horizontally slidable actuating rod 51, the other end of which bears slidably on a cam plate 52 (FIG. 3) which actuates rod 51 upon rotation of outer sleeve 9. A bracket 53 mounted on the inside of reservoir 2 guides rod 51, which is continuously urged into contact with cam 52 by a coil compression spring 54 that surrounds rod 51.

As best seen by comparison of FIGS. 3 and 4, means are provided for manual operation of lever 48, comprising an operating rod 48*a* whose end 48*b* is adapted to contact and actuate lever 48, and which is mounted on the burner for horizontal swinging movement about a pivot pin 48*c* upon manual pressure exerted on a knob 48*d* that protrudes from the burner.

As best seen in FIG. 3, cam 52 has cylindrical portions 55 and 56 at opposite ends thereof and a central cylindrical portion 59 which is connected to portions 55 and 56 by inclined portions 57 and 58, respectively. Portions 55, 56 and 59 are concentric with the axis of rotation of ring 9 and so do not cause any movement of rod 51 upon rotation of ring 9. When rod 51 contacts portion 55, wick 13 is fully lowered. When rod 51 contacts portion 56, wick 13 is in its raised combustion position; and the length of portion 56 is sufficient to permit vertical adjustment of wick 13 without any movement of rod 51.

Figure 6:
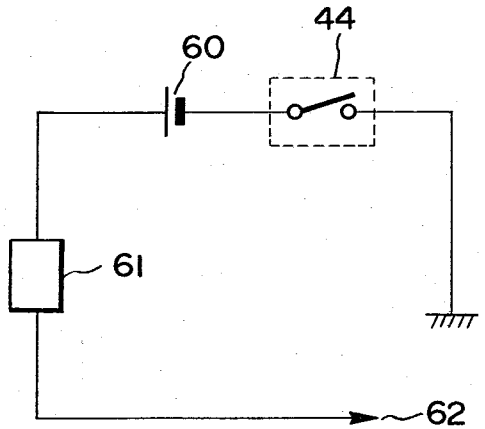
FIG. 6 is a circuit diagram of the gas ignition circuit.

FIG. 6 shows the ignition circuit for the gas contained in tank 40. A battery 60 is in circuit with the microswitch 44. An igniter 61 is detachably connected by a terminal 62 to a discharge electrode 63 which is carried by chimney 19. A baffle 63*a* is provided immediately above electrode 63, to ensure a sufficient concentration of gas adjacent electrode 63 to facilitate ignition thereof by electrode 63.

In operation, wick 13 is raised from the FIG. 4 position toward the FIG. 1 position by rotating knob 17. This turns shaft 16 and pinion 15 and so forces rack 14 to rotate ring 9. Inclined slot 12 forces pin 10 up through slot 11 of ring 8, thereby raising inner ring 7 and wick 13 that is attached to it.

As pointed out above, in the lowered position of the wick, actuating rod 51 contacts cam portion 55. But upon rotation of outer ring 9, cam 52 is slid under rod 51 until inclined portion 57 of cam 52 forces rod 51 to the left as seen in the drawings. This swings lever 48 counterclockwise and pulls rod 34 toward the right in the drawings against the action of spring 35, thereby opening valve 28 to left gas pass from tank 40 through valve 28 and outlet 36 and pipe 27 and thence into burner head 18 in which it expands in expanding chamber 20 and emerges in jets between the inner and intermediate sleeves of chimney 19 through the flame bores 21.

At the same time, movement of rod 34 to the right as seen in the drawings, causes plate 43 to close microswitch 44 thereby to cause electrode 63 to spark. This ignites the gas emerging from bores 21, which heats chimney 19 and ignites the liquid hydrocarbon with which wick 13 is saturated, which wick 13 is now approaching its uppermost position.

Upon continued rotation of ring 9, rod 51 slides along inactive cam portion 59 and then along inclined cam portion 58, whereupon the reverse of the preceding operations takes place. That is, lever 48 is swung clockwise, thanks to spring 35, and rod 34 is drawn to the left as seen in the drawings, whereupon valve 28 closes, cutting off the supply of gas from tank 40. At the same time, plate 43 moves to the left, permitting microswitch 44 to open, which interrupts the spark from electrode 63. But as the wick is now fully ignited, the gas ignition mechanism has completed its task and is no longer needed.

By this time, rod 51 is riding on inactive cam portion 56, and the height of the wick (and hence the flame characteristics) can be adjusted by manipulation of knob 17 without any other operation of the parts, so long as rod 51 slides on neutral cam portion 56.

To extinguish wick 13, knob 17 is rotated in the opposite direction, whereupon wick 13 is pulled down into wick guide cylinder 3 from the FIG. 1 position toward the FIG. 4 position, which extinguishes the wick. But as ring 9 rotates clockwise as seen in FIG. 3, rod 51 slides along inclined cam portion 58, which drives rod 51 to the left, swinging lever 48 counterclockwise and pulling rod 34 to the right, which opens valve 28 and closes switch 44, thereby supplying gas to the vicinity of electrode 63 at the same time that this electrode is caused to spark, thereby igniting this supplied gas. At first glance, this might seem a useless operation. But in fact, it is quite useful, because upon extinction of wick 13, there is emitted from the wick, which is still saturated with liquid hydrocarbon, fumes of this liquid hydrocarbon that are generated by contact between the extinguished wick and now-heated adjacent portion of the burner. If these fumes were not disposed of, they would give rise to the obnoxious odor of unburned heavy hydrocarbon fumes, which characterizes the prior art devices upon extinction of the wick. But according to the present invention, this second gas ignition, following extinction of the wick, ignites these heavier hydrocarbon fumes and so prevents the diffusion of this obnoxious ordor.

Finally, the rod 51 passes along inclined cam portion 57 to inactive cam portion 55, whereupon valve 28 again closes and microswitch 44 opens, which discontinues the supply of gas and terminates the operation of electrode 63.

Lever 48 can also be operated manually, to actuate and deactuate the supply of gas and its ignition, by manipulation of rod 48*a*, and particularly its portion 48*b* in contact with lever 48, by grasping knob 48*d* and moving it in the direction of the arrow in FIG. 3, to swing rod 48*a* about pivot 48*c*, the spring 35 tending to return the assembly to the full line position shown in FIG. 3.

In view of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A liquid hydrocarbon burner having a wick adapted to be partially immersed in liquid hydrocarbon, means to raise and lower the wick, means to supply a combustible gas to the region of an exposed portion of the wick, electric means to ignite the gas thereby to ignite liquid hydrocarbon in the wick, means responsive to raising of the wick to supply said gas and to actuate said electric means to ignite said gas, means responsive to the attainment of a raised position by said wick, to discontinue said gas supply and said ignition of said gas, and means responsive to lowering of the wick to actuate once more said gas supply and ignition, thereby to ignite fumes from the wick after extinction of the wick.

2. A burner as claimed in claim 1, and an inner ring on which said wick is mounted, an intermediate ring outside said inner ring, and an outer ring outside said intermediate ring, said inner ring being vertically movable relative to said intermediate ring, said outer ring being rotatable relative to said intermediate ring, and means responsive to rotation of said outer ring to raise or lower said inner ring.

3. Apparatus as claimed in claim 2, and means responsive to rotation of said outer ring to establish and ignite said gas supply.

4. Apparatus as claimed in claim 3, and cam means on said outer ring coacting with a lever system to control said gas supply and said ignition.

5. Apparatus as claimed in claim 1, and manually operable means to control said gas supply and said ignition.

6. A liquid hydrocarbon burner having a wick adapted to be partially immersed in liquid hydrocarbon, means to raise and lower the wick, means to supply a combustible gas to the region of an exposed portion of the wick, electric means to ignite the gas thereby to ignite liquid hydrocarbon in the wick, an inner ring on which said wick is mounted, an intermediate ring outside said inner ring, an outer ring outside said intermediate ring, said inner ring being vertically movable relative to said intermediate ring, said outer ring being rotatable relative to said intermediate ring, means responsive to rotation of said outer ring to raise or lower said inner ring, and means responsive to rotation of said outer ring to establish and ignite said gas supply.

7. Apparatus as claimed in claim 6, and cam means on said outer ring coacting with a lever system to control said gas supply and said ignition.

* * * * *